US006329961B1

(12) United States Patent
Mandai et al.

(10) Patent No.: US 6,329,961 B1
(45) Date of Patent: Dec. 11, 2001

(54) ANTENNA AND RESONANT-FREQUENCY-ADJUSTMENT METHOD THEREFOR

(75) Inventors: Harufumi Mandai, Takatsuki; Teruhisa Tsuru, Kameoka, both of (JP)

(73) Assignee: Murata Manufacturing Co., Ltd. (JP)

( * ) Notice: Subject to any disclaimer, the term of this patent is extended or adjusted under 35 U.S.C. 154(b) by 0 days.

(21) Appl. No.: 08/915,895

(22) Filed: Aug. 21, 1997

(30) Foreign Application Priority Data

Aug. 22, 1996 (JP) ..... 8-221560

(51) Int. Cl.[7] ..... H01Q 1/36; H01Q 1/24

(52) U.S. Cl. ..... 343/873; 343/700 MS; 343/702; 343/895; 343/718

(58) Field of Search ..... 343/895, 873, 343/700 MS, 702, 718

(56) References Cited

U.S. PATENT DOCUMENTS

| | | | | |
|---|---|---|---|---|
| 2,755,469 | * | 6/1956 | Etheridge | 343/895 |
| 4,215,313 | | 7/1980 | Chang et al. | 455/326 |
| 5,014,071 | | 5/1991 | King . | |
| 5,406,693 | * | 4/1995 | Egashira et al. | 29/600 |
| 5,541,610 | * | 7/1996 | Imanishi et al. | 343/702 |
| 5,559,524 | * | 9/1996 | Takei et al. | 343/895 |
| 5,592,184 | * | 1/1997 | Cassel et al. | 343/752 |
| 5,818,398 | * | 10/1998 | Tsuru et al. | 343/895 |

FOREIGN PATENT DOCUMENTS

| | | | |
|---|---|---|---|
| 587454 | | 3/1994 | (EP) . |
| 0621653 | | 4/1994 | (EP) . |
| 0687030 | | 5/1994 | (EP) . |
| 0743699 | | 6/1995 | (EP) . |
| 0706231 | | 4/1996 | (EP) . |
| 0759646 | | 8/1996 | (EP) . |
| 0762539 | | 8/1996 | (EP) . |
| 0759646 | | 2/1997 | (EP) . |
| 0771047 | | 2/1997 | (EP) . |
| 0790665 | | 2/1997 | (EP) . |
| 0802577 | | 4/1997 | (EP) . |
| 2532120 | | 2/1984 | (FR) . |
| 2275826 | | 9/1994 | (GB) . |
| 0 790 665 | * | 2/1997 | (JP) ..... 1/36 |

OTHER PUBLICATIONS

Patent Abstracts of Japan, vol. 095, No. 009, Oct. 31, 1995, & JP 07–154141, Jun. 16, 1995.

Liang Han, et al., "An Integrated Transition of Microstrip to Nonradiative Dielectric Waveguide for Microwave and Millimeter–Wave Circuits", *IEEE Transactions on Microwave Theory and Techniques,* vol. 44, No. 7, part 1, Jul. 1, 996, pp. 1091–1096.

* cited by examiner

*Primary Examiner*—Don Wong
*Assistant Examiner*—James Clinger
(74) *Attorney, Agent, or Firm*—Ostrolenk, Faber, Gerb & Soffen, LLP

(57) ABSTRACT

An antenna includes a spirally wound conductor composed of a copper wire or a covered copper wire, and a covering material consisting essentially of a resin or a resin mixture with $1<\epsilon\leqq 10$. At least part of the conductor is covered with the covering material. One end of the conductor leads to the outside of the covering material to form an external terminal. Another end of the conductor forms a free end in the covering material. In addition, a method for adjusting the resonant frequency of the antenna includes at least the step of changing a winding interval of a part of the conductor which is not covered with the covering material or the step of covering with the covering material a part of the conductor which is not covered with the covering material, or both. Furthermore, the antenna preferably satisfies the following numerical expression: $1.3\leqq l/a\cdot n\leqq 4$ where l represents the coil length of said conductor; a represents the diameter of said conductor; and n represents the number of turns of said conductor.

13 Claims, 3 Drawing Sheets

ANTENNA AND RESONANT-FREQUENCY-ADJUSTMENT METHOD THEREFOR

BACKGROUND OF THE INVENTION

1. Field of the Invention

The present invention relates to antennas and resonant-frequency-adjustment methods therefor, and in particular, to an antenna and a resonant-frequency-adjustment method therefor which are for use in a portable radio.

2. Description of the Related Art

Whip antennas are conventionally used for portable radio devices such as liquid-crystal televisions (90 to 800 MHz) and FM radios (75 to 90 MHz) (88 to 108 MHz in the U.S.) (hereinafter referred to generally as "portable radios"). Loop antennas are used for pagers.

A conventional whip antenna must be extended for use. In a frequency band equal to or less than 1 GHz, the length of the whip antenna needs to be 7.5 cm or longer, which makes it unstable when setting up a portable radio, and presents a problem when the radio falls.

SUMMARY OF THE INVENTION

Accordingly, it is an object of the present invention to provide a small-sized antenna which can be built into the casing of a portable radio.

To this end, according to an aspect of the present invention, the foregoing object may be achieved through provision of an antenna in which the whole or part of a coiled conductor composed of a metallic wire is covered with a covering material comprising a resin, or a mixture of such a resin and a filler, having a dielectric constant e where $1<\epsilon\leqq 10$.

According to another aspect of the present invention, the foregoing object may be achieved through provision of an antenna in which the whole or part of a base member composed of a dielectric material, having a conductor wound on the surface thereof, is covered with a covering material composed of a resin or a mixture of the resin and a filler having a dielectric constant $\epsilon$ where $1<\epsilon\leqq 10$.

Preferably, the antennas satisfy the following numerical expression: $1.3\leqq l/a \cdot n\leqq 4$ where l represents the coil length of the conductor; a: the diameter of the conductor; and n: the number of turns of the conductor.

In each antenna one end of the conductor may be connected to an input/output terminal formed on the surface of the covering material.

According to a further aspect of the present invention, the foregoing object may be achieved through provision of a method for adjusting the resonant frequency of the antenna, in which the method comprises either the step of changing a winding interval for a part of the conductor which is not covered with the covering material, or the step of covering with a mixture of a resin and a filler a part of the conductor which is not covered with the covering material.

According to the foregoing aspects of the present invention, a coiled conductor is covered with a covering material composed of a resin or a mixture of the resin and a filler, the covering material having a dielectric constant $\epsilon$ expressed as $1<\epsilon\leqq 10$. The covering material has a wavelength shortening effect which can electrically shorten the coil length of the conductor. Accordingly, the desired characteristics of an antenna are satisfied, and compared with a conventional monopole antenna, the antenna can be reduced in size to 1/9 or less of the volume of the conventional whip antenna in a frequency band at or below 1 GHz, and can be built into the casing of a portable radio.

By satisfying the relation $1.3\leqq l/a \cdot n\leqq 4$, the characteristics of an antenna can be improved without enlarging the size of the antenna.

Since a coiled conductor is wound on the surface of a base member, changes in the cross-sectional shape of the winding, taken perpendicular to the winding axis, and changes in its winding pitch, can be avoided. Therewith, undesirable changes in the antenna characteristics can be reduced.

If the surface of a covering material is provided with an input/output terminal, the antenna can be easily surface-mounted.

The resonant frequency of the antenna can be adjusted by either the step of changing a winding interval of the conductor which is not covered with the covering material, or the step of covering with a resin, or a mixture of a resin and filler, a part of the conductor which is not covered with the covering material. Thus, the antenna can be adjusted with the antenna mounted on a mounting board.

DESCRIPTION OF EMBODIMENTS OF THE INVENTION

Figure 1:
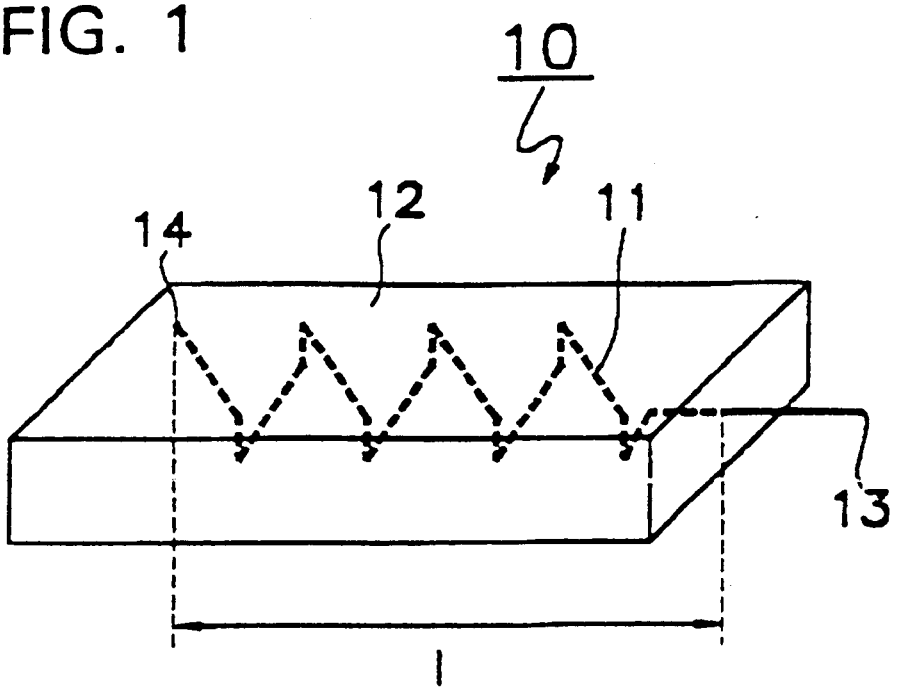
FIG. 1 is a perspective view illustrating an antenna according to a first embodiment of the present invention.

FIG. 1 shows a perspective view of an antenna according to a first embodiment of the present invention.

The antenna 10 includes a spirally wound conductor 11 composed of a copper wire or a covered copper wire, and a covering material 12 composed of a resin or a mixture of the resin and a filler. The whole conductor 11 is covered with the covering material 12. One end of the conductor 11 leads to the outside of the covering material 12 to form an external terminal 13. Another end of the conductor 11 forms a free end 14 inside the covering material 12.

The following Table 1 shows the resonant frequency (f0) and relative bandwidth (BW/f0:bandwidth/resonant frequency) of the antenna 10 obtained when materials with a dielectric constant ($\epsilon$) of 1 to 14 are used as the covering material 12. The materials used as the covering material 12 are a fluororesin ($\epsilon$:2), an epoxy resin ($\epsilon$:4), and a mixture ($\epsilon$:6 to 14) of the epoxy resin and a filler chiefly composed of titanium.

TABLE 1

| $\epsilon$ | f0 (MHz) | BW/f0 (%) |
|---|---|---|
| 1 | 800 | 6.0 |
| 2 | 710 | 5.9 |
| 4 | 630 | 5.8 |
| 6 | 555 | 5.7 |

TABLE 1-continued

| ϵ | f0 (MHz) | BW/f0 (%) |
|---|---|---|
| 8 | 500 | 5.6 |
| 10 | 480 | 5.4 |
| 12 | 470 | 5.0 |
| 14 | 460 | 4.6 |

From the results of Table 1 it is understood that an antenna having the materials with dielectric constants of 1 to 10 exhibits a small change in the ratio between the relative bandwidth and the resonant frequency in accordance with a change in the resonant frequency. However, the materials having dielectric constants larger than 10 exhibit a large change in the ratio between the relative bandwidth and the resonant frequency in accordance with a change in the resonant frequency. Consequently, it is found that a resin or a mixture of the resin and a filler with 1< dielectric constant ≦10 is suitable for the covering material 12. The dielectric constant =1 represents a condition without the covering material 12, and is accordingly omitted.

The reason why an increase in the dielectric constant increases a change in the ratio between relative bandwidth and the resonant frequency with respect to a change in the resonant frequency is that a capacitive component is added in parallel to the coiled conductor 11 included in the antenna 10, and the capacitive component and the inductive component of the conductor 11 constitute an antiresonant point narrowing the bandwidth. Accordingly, a suitable bandwidth for the antenna can be provided by adjusting the dielectric constant of the covering material 12.

The following Table 2 shows the resonant frequency (f0) and relative bandwidth (BW/f0:bandwidth/resonant frequency) of the antenna 10 obtained when l/a ·n (where 1: the coil length of a conductor; a: the diameter of the conductor; and n; the number of turns of the conductor) is set from 1.1 to 6.0. Constant values are a: 0.3(mm), n: 22(turns) in this example.

TABLE 2

| 1 | 1/a n | f0 (MHZ) | BW/f0 (%) |
|---|---|---|---|
| 6.6 | 1.1 | 200 | 1.2 |
| 7.2 | 1.2 | 210 | 2.0 |
| 7.8 | 1.3 | 220 | 3.8 |
| 12 | 2.0 | 250 | 5.5 |
| 18 | 3.0 | 300 | 6.0 |
| 24 | 4.0 | 350 | 6.5 |
| 30 | 5.0 | 400 | 6.8 |
| 36 | 6.0 | 450 | 7.0 |

From the results in Table 2 it is understood that, when l/a ·n decreases to less than 1.3, the relative bandwidth (BW/f0) decreases to sharply narrow the bandwidth. This reason is that an increase in the floating capacitance of the coiled conductor 12 causes the antiresonant point to approach the resonant point. In addition, when l/a ·n increases to more than 4, there is little additional change in the ratio between the relative bandwidth and the resonant frequency. In other words, it is understood that, even if the coil length is increased by enlarging the shape of the antenna, it is difficult to improve the antenna characteristics any further.

Specifically, when a comparison in size is made between a whip antenna having a resonant frequency of 47.2 MHz and the antenna 10 having the same frequency in which the conductor 11 is covered with the covering material 12 consisting essentially of a mixture of an epoxy resin having a dielectric constant of 6 and a filler chiefly composed of titanium, it is found that the whip antenna is approximately 158 cm long, while the antenna 10 is 5 mm wide, 8 mm deep, and 2.5 mm high, which is approximately 1/200 of the volume of the conventional whip antenna.

Also in a frequency bandwidth at or below 1 GHz in which the length of the whip antenna needs to be 7.5 cm or more, the antenna 10 is 1/9 or less in size.

According to the first embodiment, by using a material with 1< dielectric constant ≦10, the desired characteristics of an antenna are satisfied, and when compared with a conventional monopole antenna, the size of the antenna can be reduced to 1/9 in a frequency band equal to or less than 1 GHz. Accordingly, the antenna can be built into the casing of a portable radio.

In addition, by setting l/a ·n in the range of 1.3 to 4, the characteristics of the antenna can be improved without enlarging the size of the antenna. For example, its bandwidth can be broadened. The mentioned advantages can be sufficiently obtained when the number n of turns is 5 to 100.

Figure 2:
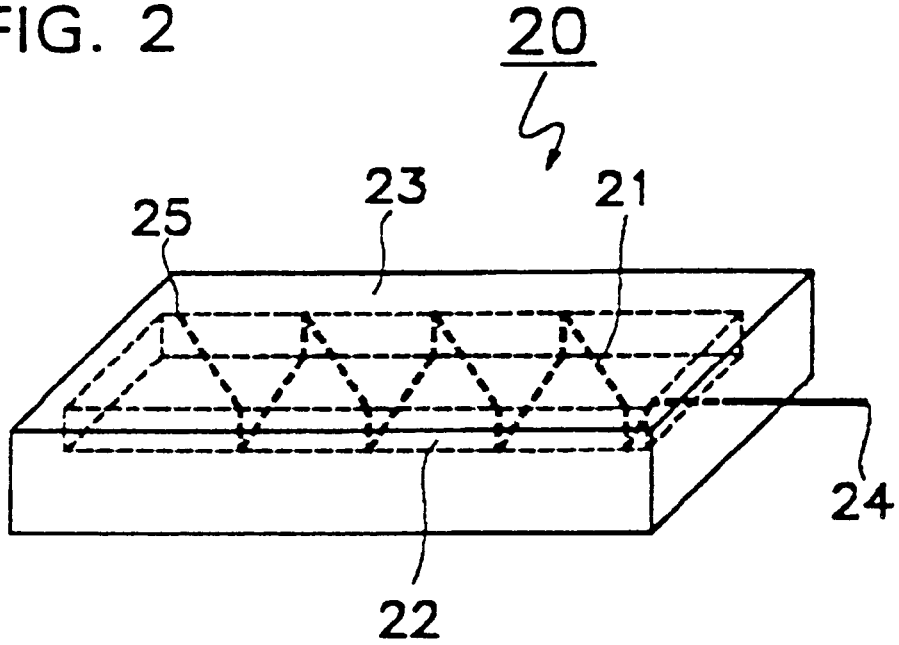
FIG. 2 is a perspective view illustrating an antenna according to a second embodiment of the present invention.

FIG. 2 shows a perspective view of an antenna according to a second embodiment of the present invention.

The antenna 20 includes: a base member 22 comprising a dielectric material chiefly composed of barium oxide, aluminum oxide and silica and having a wound conductor 21 composed of copper or a copper alloy on its surface; and a covering material 23 comprising a mixture of an epoxy resin and a filler chiefly composed of titanium. The entire conductor 21 and base member 22 are covered with the covering material 23. One end of the conductor 21 leads to the outside of the covering material 23 to form an external terminal 24. Another end of the conductor 21 forms a free end 25 inside the covering material 23.

According to the second embodiment, spirally winding a conductor on the surface of a base member avoids inadvertent changes in the cross-sectional shape of the wound conductor, taken perpendicular to the winding axis, and in the winding pitch. Therewith, inadvertent changes in the antenna characteristics are avoided.

Figure 3:
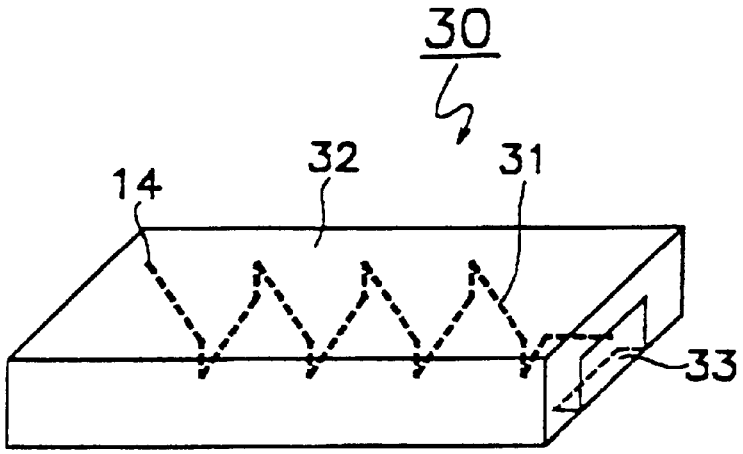
FIG. 3 is a perspective view illustrating an antenna according to a third embodiment of the present invention.

FIG. 3 shows a perspective view of an antenna according to a third embodiment of the present invention.

Compared with the antenna 10 according to the first embodiment, the antenna 30 differs in that one end of a conductor 31 leads to the surface of a covering material 32, and is connected to a signal input/output terminal 33 for connecting the conductor 31 with an external transmitter and/or receiver circuit.

According to the third embodiment, the input/output terminal is formed on the surface of the covering material 32. Thus, the surface mounting of the antenna can be easily performed.

In the first to third embodiments, a coiled conductor, or a conductor and a base member on which this conductor is spirally wound, is entirely covered with a covering material having a dielectric constant ϵ expressed as 1<ϵ≦10. However, the covering material may only partially cover the coiled conductor or the conductor and the base member on which the conductor is spirally wound. In such an arrangement, the resonant frequency of an antenna can be adjusted by changing a winding interval of a part of the conductor which is not covered with the covering material, or by covering with a resin, or a mixture of a resin and filler a part of the conductor which is not covered with the covering material, or both. Such an adjustment can be performed with the antenna mounted on a mounting board.

Also, the first to third embodiments have described cases in which a filler chiefly composed of titanium is used as a filler included in a covering material. However, fillers which are chiefly composed of alumina, barium titanate and so forth may be used.

In addition, cases in which one conductor is used have been described. However, a plurality of conductors arranged in parallel may be included. This enables an antenna to have a plurality of resonant frequencies in accordance with the number of conductors. Thus, one antenna can be used in a plurality of bands.

Figure 4A:
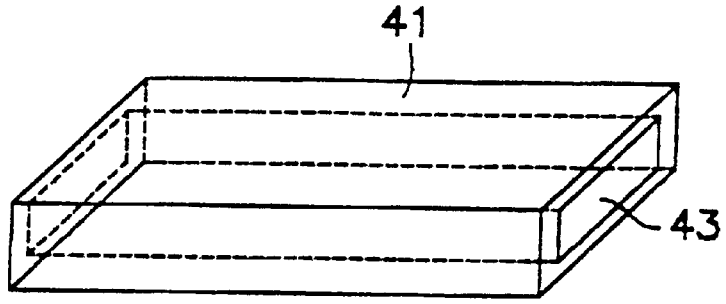
FIGS. 4A, 4B and 4C are perspective views illustrating respective modifications of a base member included in the antenna shown in FIG. 2.
Figure 4B:
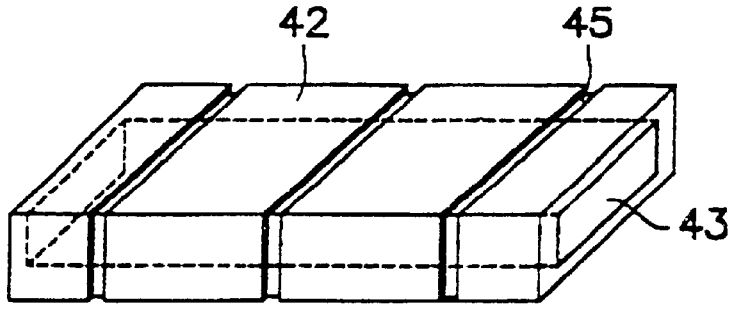

The second embodiment has described a case in which a base member on which a conductor is wound is plate-shaped. However, in modified embodiments as shown in FIG. 4A and FIG. 4B, spaces 43 are formed in base members 41 and 42. When the space is formed in the base member, the dielectric constant of the inside of the base member decreases. Thus, an antiresonant point can be moved away from a resonant point, thereby reducing a corresponding decrease in the bandwidth.

Figure 4C:
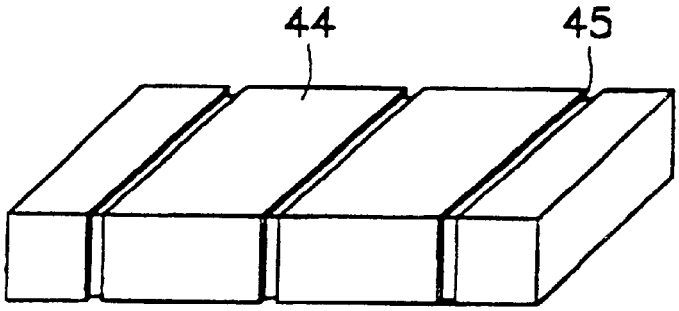

In addition, as shown in FIG. 4B and FIG. 4C, the surfaces of the base member 42 and a base member 44 may be provided with grooves 45. When grooves for winding the conductor are formed on the surface of a base member, the precision of the position where the conductor is wound can be improved. Thus, a change in antenna characteristics can be suppressed.

Figure 5:
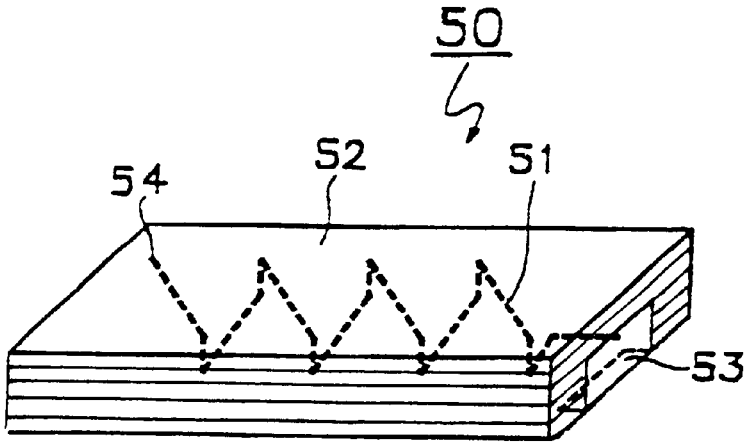
FIG. 5 is a perspective view illustrating an antenna according to a fourth embodiment of the invention.

FIG. 5 is a perspective view illustrating an antenna according to a fourth embodiment of the invention. Unlike the antennas 10, 20 and 30 according to the first, second and third embodiments, the antenna 50 in FIG. 5 comprises a plurality of ceramic dielectric layers. A conductor 51 extends from a free end 54 to an external terminal 53. The conductor 51 is directly covered with a resin or a mixture of a resin and a filler which has a dielectric constant $\epsilon$, wherein $1<\epsilon\leqq 10$ as in the previous embodiments. However, the portions of the ceramic dielectric layers that contact each other are not coated with the resin or the mixture in order not to prevent the adjacent layers from electrically contacting each other.

What is claimed is:

1. An antenna comprising a base member comprising a dielectric material having a conductor wound on the surface thereof, the conductor comprising a coiled conductor, the coiled conductor comprising a metallic wire at least partially but not completely covered with a covering material comprising a resin or a mixture of a resin and a filler having a dielectric constant $\epsilon$ wherein $1<\epsilon\leqq 10$, the base member having an aperture which extends within the coiled conductor.

2. An antenna according to claim 1, wherein said antenna satisfies the following numerical expression: $1.3\leqq l/a \cdot n\leqq 4$ where l represents the coil length of said conductor; a represents the diameter of said conductor; and n represents the number of turns of said conductor.

3. An antenna according to claim 2, wherein the number n of said turns of said conductor is substantially 5 to 100.

4. An antenna according to claim 1, wherein one end of said conductor is connected to a terminal formed on the surface of said covering material.

5. A method for adjusting the resonant frequency of an antenna in which at least part of a base member comprises a dielectric material, having a conductor wound on the surface thereof, the conductor comprising a coiled conductor covered with a covering material comprising a resin or a mixture of a resin and a filler having a dielectric constant $\epsilon$ where $1<\epsilon\leqq 10$, wherein said method comprises the step of changing a winding interval of a part of said conductor which is not covered with said covering material, and further comprising providing an aperture in said base member which extends in said conductor.

6. An antenna according to claim 2, wherein one end of said conductor is connected to a terminal formed on the surface of said covering material.

7. An antenna according to claim 1, wherein said base member has a groove therein for defining a winding path of said conductor.

8. A method according to claim 5, wherein said base member has a groove therein for defining a winding path of said conductor.

9. A method for adjusting the resonant frequency of an antenna in which at least part of a base member comprises a dielectric material, having a conductor wound on the surface thereof, the conductor comprising a coiled conductor covered with a covering material comprising a resin or a mixture of a resin and a filler having a dielectric constant $\epsilon$ where $1<\epsilon\leqq 10$, wherein said method comprises the step of changing a winding interval of a part of said conductor which is not covered with said covering material, and further comprising providing said base member with a groove therein for defining a winding path of said conductor.

10. An antenna according to claim 1, wherein said antenna comprises a base having a plurality of dielectric ceramic layers, said base containing said coiled conductor, said coiled conductor being at least partially covered with said covering material.

11. An antenna according to claim 10, wherein said covering material is coated directly on said metallic wire.

12. An antenna according to claim 11, wherein respective portions of said ceramic dielectric ceramic layers which electrically contact each other are substantially free of said covering material so as to permit said electrical contact.

13. An antenna comprising a base member comprising a dielectric material having a conductor wound on the surface thereof, the conductor comprising a coiled conductor, the coiled conductor comprising a metallic wire at least partially but not completely covered with a covering material comprising a resin or a mixture of a resin and a filler having a dielectric constant $\epsilon$ wherein $1<\epsilon\leqq 10$, and further wherein the base member has a groove therein for defining a winding path of the conductor.

* * * * *